US008894555B2

(12) United States Patent
Colledge et al.

(10) Patent No.: US 8,894,555 B2
(45) Date of Patent: Nov. 25, 2014

(54) HAND-HELD COMBINATION EXERCISE DEVICE

(75) Inventors: Matthew D. Colledge, Logan, UT (US); Michael L. Olson, Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 359 days.

(21) Appl. No.: 13/544,853

(22) Filed: Jul. 9, 2012

(65) Prior Publication Data

US 2013/0017936 A1 Jan. 17, 2013

Related U.S. Application Data

(60) Provisional application No. 61/508,475, filed on Jul. 15, 2011.

(51) Int. Cl.

| | |
|---|---|
| ***A63B 21/00*** | (2006.01) |
| ***A63B 21/012*** | (2006.01) |
| ***A63B 21/015*** | (2006.01) |
| ***A63B 23/14*** | (2006.01) |
| ***A63B 22/20*** | (2006.01) |
| ***A63B 23/12*** | (2006.01) |

(52) U.S. Cl.

CPC ..... *A63B 21/1469* (2013.01); *A63B 21/0004* (2013.01); *A63B 21/015* (2013.01); *A63B 21/1484* (2013.01); *A63B 21/1496* (2013.01); *A63B 22/203* (2013.01); *A63B 23/12* (2013.01); *A63B 23/14* (2013.01); *A63B 21/00069* (2013.01)

USPC ..... 482/132; 482/118; 482/46

(58) Field of Classification Search

CPC .. A63B 22/20; A63B 22/002; A63B 21/1496; A63B 21/068; A63B 21/012; A63B 21/015; A63B 21/00185; A63B 23/02; A63B 23/0211; A63B 23/16; A63B 23/14

USPC ..... 482/44, 45, 46, 131, 132, 118, 114, 138

See application file for complete search history.

(56) References Cited

U.S. PATENT DOCUMENTS

| | | | | | |
|---|---|---|---|---|---|
| 2,131,570 | A | * | 9/1938 | Riley | 482/72 |
| 2,668,055 | A | * | 2/1954 | Sharp et al. | 482/46 |
| 2,920,418 | A | * | 1/1960 | Britt | 446/241 |
| 2,973,962 | A | * | 3/1961 | Griffin | 482/46 |
| 3,184,234 | A | * | 5/1965 | Struble | 482/46 |
| 3,211,453 | A | * | 10/1965 | Williams | 482/46 |
| 3,708,164 | A | * | 1/1973 | Griffin | 482/46 |
| 3,717,338 | A | * | 2/1973 | Hughes | 482/46 |
| 3,752,475 | A | * | 8/1973 | Ott | 482/127 |
| 3,938,803 | A | * | 2/1976 | Wilmoth et al. | 482/132 |

(Continued)

*Primary Examiner* — Loan H Thanh
*Assistant Examiner* — Sundhara Ganesan
(74) *Attorney, Agent, or Firm* — Workman Nydegger Holland & Hart LLP

(57) ABSTRACT

In general, various embodiments of hand-held exercise devices that can be used to perform different types of exercises that focus on different muscular groups of the body are disclosed. Specifically, the hand-held exercise devices disclosed herein can be used to perform arm exercises as well as abdominal and core muscle exercises. The hand-held exercise devices can include a first handle and a second handle, which rotate about a central axis relative to one another. The hand-held exercise devices can also include a wheel, which may also rotate about the central axis. Resistance can be applied to the relative rotation of the handles and, optionally, to the rotation of the wheel. The resistance can be selectively varied by a user.

17 Claims, 5 Drawing Sheets

(56) References Cited

U.S. PATENT DOCUMENTS

| | | | | |
|---|---|---|---|---|
| 4,799,668 | A * | 1/1989 | Jansen | 482/57 |
| 5,364,324 | A * | 11/1994 | Boettiger, Jr. | 482/46 |
| 5,637,065 | A * | 6/1997 | Chang | 482/114 |
| 5,707,325 | A * | 1/1998 | Chiou | 482/132 |
| 5,776,034 | A * | 7/1998 | Stamler | 482/46 |
| 5,820,521 | A * | 10/1998 | Edwards et al. | 482/44 |
| 6,174,269 | B1 * | 1/2001 | Eschenbach | 482/132 |
| 6,203,476 | B1 * | 3/2001 | Wang et al. | 482/121 |
| 6,398,694 | B1 * | 6/2002 | Bountourakis | 482/44 |
| 6,837,837 | B2 * | 1/2005 | Nethery | 482/132 |
| 7,285,080 | B1 * | 10/2007 | Chiu | 482/142 |
| 7,387,599 | B1 * | 6/2008 | Hsu | 482/132 |
| 7,837,603 | B1 * | 11/2010 | Carnell, Sr. | 482/132 |
| 8,641,586 | B2 * | 2/2014 | Bremer et al. | 482/129 |
| 2002/0025894 | A1 * | 2/2002 | Fernandez | 482/140 |
| 2002/0123416 | A1 * | 9/2002 | Huang | 482/140 |
| 2003/0017921 | A1 * | 1/2003 | Lee | 482/136 |
| 2003/0022770 | A1 * | 1/2003 | Lee | 482/136 |
| 2003/0096680 | A1 * | 5/2003 | Nethery | 482/92 |
| 2003/0158023 | A1 * | 8/2003 | Yu | 482/126 |
| 2005/0101454 | A1 * | 5/2005 | Dworzan | 482/110 |
| 2008/0167168 | A1 * | 7/2008 | Hurst | 482/132 |
| 2010/0267523 | A1 * | 10/2010 | Wilkinson et al. | 482/45 |
| 2011/0160024 | A1 * | 6/2011 | Candela et al. | 482/132 |
| 2011/0183824 | A1 * | 7/2011 | Yang | 482/132 |
| 2012/0100969 | A1 * | 4/2012 | Brodbeck | 482/132 |
| 2012/0172184 | A1 * | 7/2012 | Wang | 482/132 |
| 2012/0264578 | A1 * | 10/2012 | Frederick | 482/132 |
| 2013/0237377 | A1 * | 9/2013 | Wilkinson et al. | 482/45 |

* cited by examiner

HAND-HELD COMBINATION EXERCISE DEVICE

RELATED U.S. APPLICATIONS

This application claims priority from U.S. provisional application No. 61/508,475 filed on Jul. 15, 2011.

TECHNICAL FIELD

In general, the present invention relates to exercise devices for performing multiple exercises that focus on differing muscle groups including forearm, abdominal, and core muscles groups.

BACKGROUND

Small, hand-held exercise devices have become an increasingly popular way to work out for a variety of reasons. To begin, most hand-held exercise devices do not require a large amount of space to use or to store. Indeed, some hand-held exercise devices are small enough to be stored in a closet, under a bed, or in another discrete location. Hand-held exercise devices can also be portable. Some hand-held exercise devices can be packed in a suitcase or in a car and used when the owner is away from home. In addition, some hand-held exercise devices allow a user to work out while he or she is engaged in another activity. For example, some hand-held exercise devices can be used while a person is watching television, talking on the phone, or reading a book. Finally, hand-held exercise devices are often less expensive to purchase than larger stationary exercise devices.

Hand-held exercise devices can function in a variety of ways. Some hand-held exercise devices can assist a user in maintaining a proper form during an exercise. Other hand-held exercise devices provide resistance for a user to perform an exercise. Regardless of how the hand-held exercise device works, hand-held exercise devices are often limited to a target area or muscle group of the body. Hand-held exercise devices are also often restricted to a single exercise. For example, one hand-held exercise device may assist a user in performing exercises that work out arm muscles while a different hand-held exercise device may assist a user in performing exercises that work out abdominal and/or core muscles.

In light of these limitations, a user that wants to work out multiple parts of his or her body using hand-held exercise devices may need to acquire a large number of hand-held exercise devices. For example, if a user wants to work out his or her arms, as well as his or her core muscles, two different hand-held exercise devices may be required. Thus, a hand-held exercise device that is compact, affordable, versatile, and that can effectively workout multiple parts of the body is desirable.

SUMMARY OF THE INVENTION

In one aspect of the disclosure, an exercise device includes a first handle, a second handle, and a wheel.

In another aspect that may be combined with any of the aspects herein, the handles have outer grip portions.

In another aspect that may be combined with any of the aspects herein, the first and second handles are rotatable in opposite directions about a central axis.

In another aspect that may be combined with any of the aspects herein, the wheel is rotatably disposed about at least one of the handles.

In another aspect that may be combined with any of the aspects herein, the wheel is rotatable about the central axis independently of the relative rotation of the first and second handles.

In another aspect that may be combined with any of the aspects herein, the first handle and second handle are in direct contact with one another.

In another aspect that may be combined with any of the aspects herein, the exercise device includes at least one friction disc.

In another aspect that may be combined with any of the aspects herein, the friction disc is positioned between the first handle and the second handle.

In another aspect that may be combined with any of the aspects herein, the friction disc is made at least in part from leather.

In another aspect that may be combined with any of the aspects herein, the plane on which the wheel rotates lies between the outer grip portion of the first handle and the outer grip portion of the second handle.

In another aspect that may be combined with any of the aspects herein, the exercise device further comprises a stretchable band.

In another aspect that may be combined with any of the aspects herein, the stretchable band having a first end and a second end, the first end being secured to the first handle and the second end being secured to the second handle.

In another aspect that may be combined with any of the aspects herein, the exercise device further comprises a first hook secured to the first end of the stretchable band and a second hood secured to the second end of the stretchable band, wherein the first and second hooks can be selectively secured to the first and second handles.

In another aspect that may be combined with any of the aspects herein, the stretchable band further includes a pad that can be positioned behind a user's feet or legs during performance of an exercise.

In another aspect that may be combined with any of the aspects herein, the exercise device further comprises an adjustment rod secured to the first handle.

In another aspect that may be combined with any of the aspects herein, the adjustment rod has an external threaded portion at one end.

In another aspect that may be combined with any of the aspects herein, the exercise device further comprises an adjustment knob rotatably securable to the adjustment rod.

In another aspect that may be combined with any of the aspects herein, the adjustment knob has an internal threaded portion that mates with the external threaded portion on the adjustment rod.

In another aspect that may be combined with any of the aspects herein, at least a portion of the second handle is positioned between the adjustment knob and the first handle such that as the adjustment knob is tightened on the adjustment rod, the first and second handles are brought closer together.

In another aspect that may be combined with any of the aspects herein, a rotational resistance on the wheel is selectively adjustable by rotating the adjustment knob.

In another aspect that may be combined with any of the aspects herein, a method for performing arm and core muscle exercises using a single exercise device includes providing an exercise device having a first handle rotatably connected to a second handle and a wheel rotatably disposed about at least one of the first and second handles, the wheel being rotatable independently of the relative rotation of the first and second handles.

In another aspect that may be combined with any of the aspects herein, the method further includes gripping the first handle in a first hand.

In another aspect that may be combined with any of the aspects herein, the method further includes gripping the second handle in a second hand.

In another aspect that may be combined with any of the aspects herein, the method further includes twisting the first and second handles in opposite rotational directions.

In another aspect that may be combined with any of the aspects herein, the method further includes rotating the wheel on a support surface to move a user's body from a prone position to a kneeling position.

DETAILED DESCRIPTION

In general, embodiments of the invention provide a simple and efficient hand-held exercise device that allows a user to perform different exercises and work out different muscle groups. More specifically, the embodiments disclosed herein relate to hand-held exercise devices that include handles that a user can rotate in opposite directions about an axis to exercise arm muscles. The hand-held exercise device can also include a wheel that is secured to one or both handles. A user can exercise his or her abdominal and/or core muscles by rolling the wheel on a support surface, while grasping the handles, to go from a kneeling position to prone position and back, repeatedly.

Figure 1:
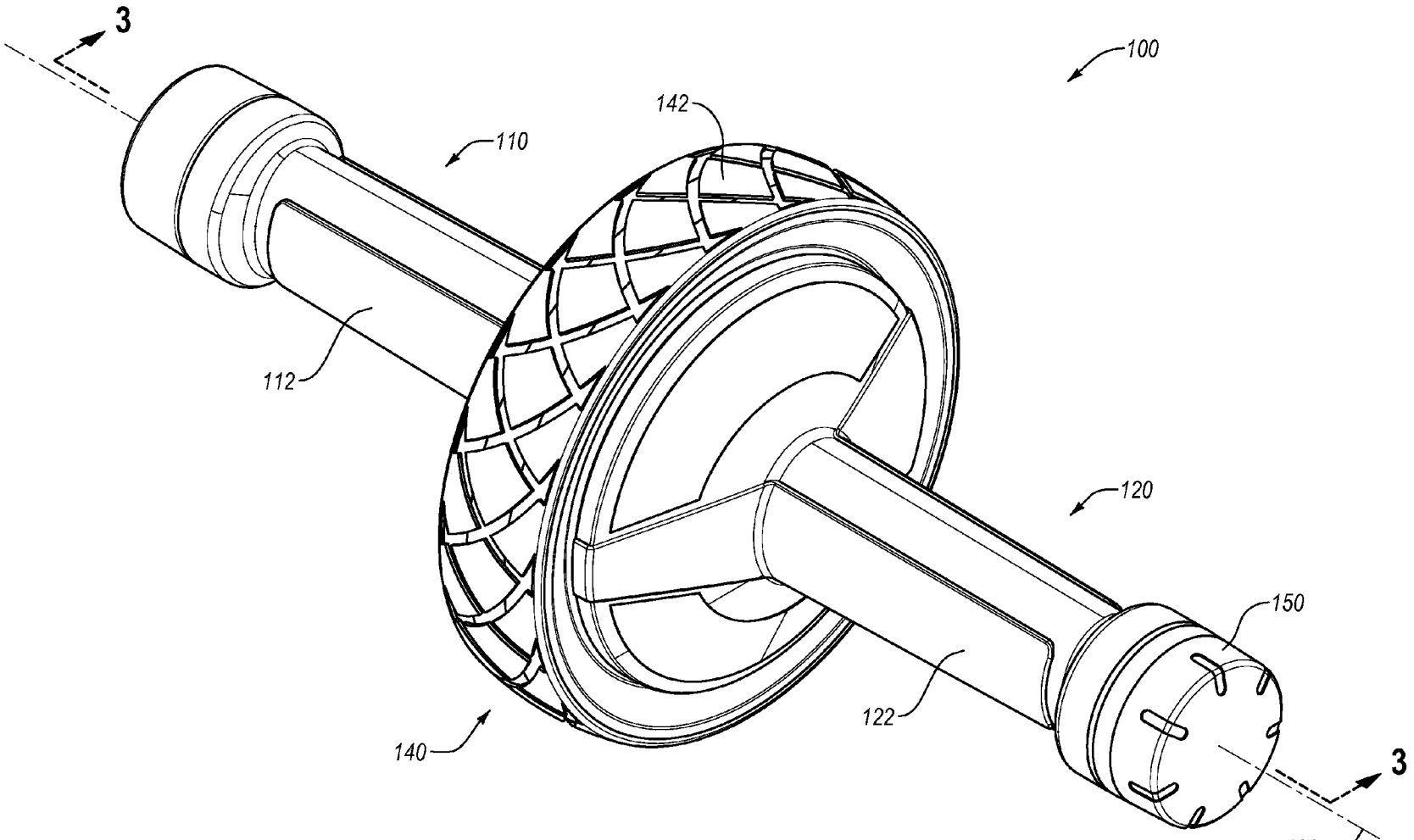
FIG. 1 illustrates a perspective view of a hand-held exercise device according to the present invention.

FIG. 1 illustrates a perspective view of a hand-held exercise device 100. Exercise device 100 includes a first handle 110. First handle 110 includes a first outer grip portion 112. Exercise device 100 also includes a second handle 120 with a second outer grip portion 122. An outer grip portion of a handle can be any surface on first handle 110 and/or second handle 120 that is configured to be gripped by a user during the performance of an exercise. An outer grip portion of a handle may, but need not, include a slip-resistant material. For example, first and second outer grip portions 112 and 122 can be covered, in whole or in part, with a textured or non-slip material, such as rubber or foam.

First handle 110 and second handle 120 are rotatable in opposite directions about a central axis 130. Exercise device 100 also includes an adjustment knob 150. As explained in more detail hereafter, a user can rotate adjustment knob 150 to selectively increase or decrease the rotational resistance between the first handle 120 and the second handle 130.

Exercise device 100 also includes a wheel 140. On exercise device 100, wheel 140 also rotates about central axis 130. Wheel 140 can rotate independently of the relative rotation between first and second handles 110 and 120. Wheel 140 includes an outer tread 142, which can provide wheel 140 additional traction with a support surface upon which the wheel rotates during performance of an exercise. Tread 142 can comprise, in whole or in part, a textured or non-slip material, such as rubber or foam. Adjustment knob 150 can also be rotated to selectively increase or decrease the rotational resistance on wheel 140.

As shown in FIG. 1, the plane on which wheel 140 rotates lies between first outer grip portion 112 of first handle 110 and second outer grip portion 122 of second handle 120. Thus, during performance of an exercise with exercise device 100, wheel 140 rotates between the hands of a user.

Figure 2:
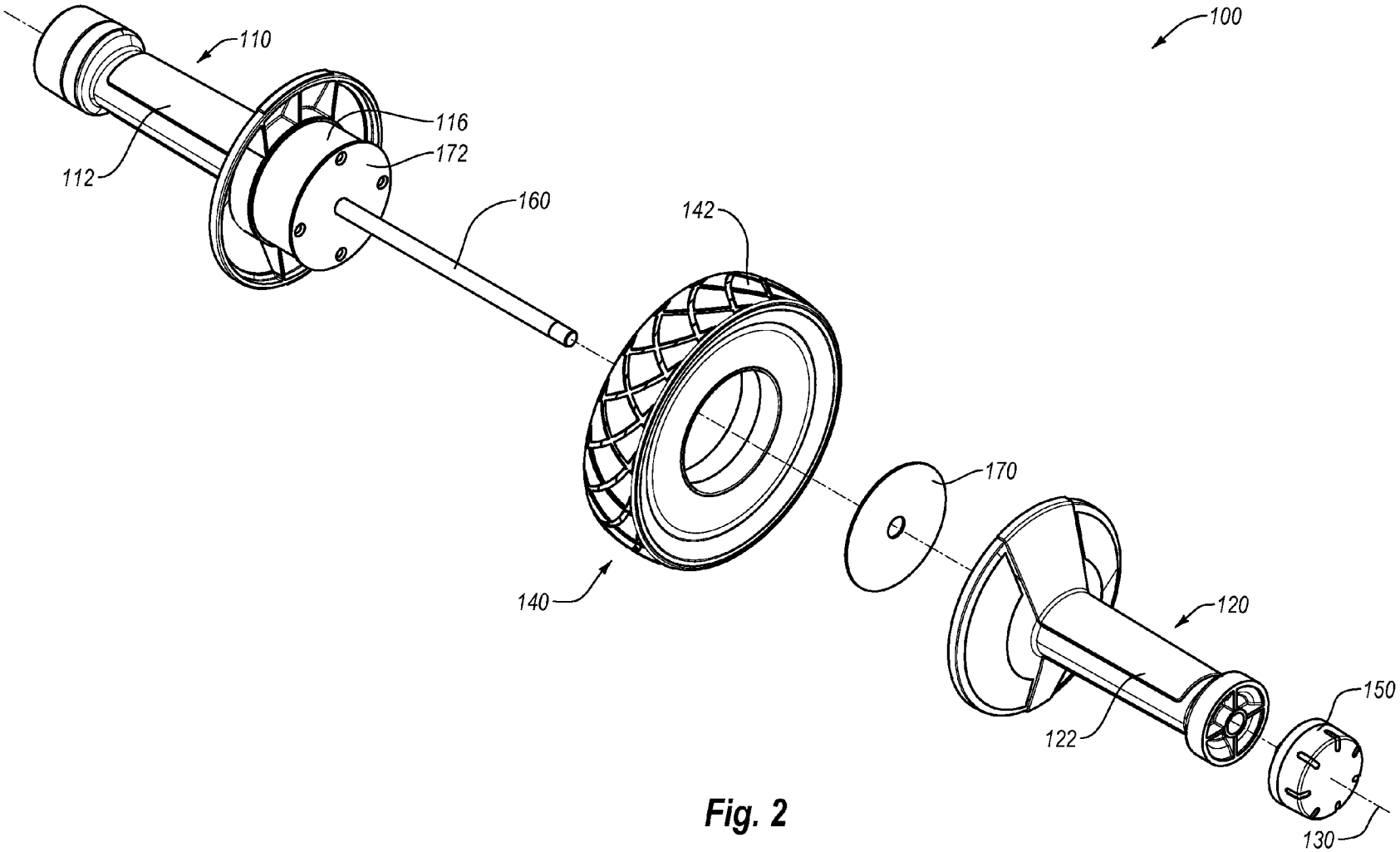
FIG. 2 illustrates an exploded view of the hand-held exercise device of FIG. 1.

FIG. 2 illustrates an exploded view of exercise device 100. As can be seen in FIG. 2, first handle 110 includes a hub 116. Wheel 140 can be rotatably disposed about hub 116 such that wheel 140 can rotate about hub 116. Hub 116 and first handle 110 can be manufactured together as one unitary piece or hub 116 can be manufactured separately from first handle 110 and thereafter connected to first handle 110.

FIG. 2 also illustrates an adjustment rod 160. Adjustment rod 160 is cylindrical in shape and is positioned approximately along central axis 130. Hand-held exercise device 100 also includes friction discs 170, 172, and 174 (friction disc 174 is illustrated in FIG. 3A). As discussed in more detail below, friction discs 170, 172, and 174 provide surfaces upon which a rotational resistance between first handle 110 and second handle 120 can be applied. Friction discs 172 and 174 can be integrally formed as part of handles 110 and 120, respectively. Alternatively, friction discs 172 and 174 can be formed separately from handles 110 and 120 and positioned on the appropriate surfaces of the handles during the assembly process.

Figure 3:
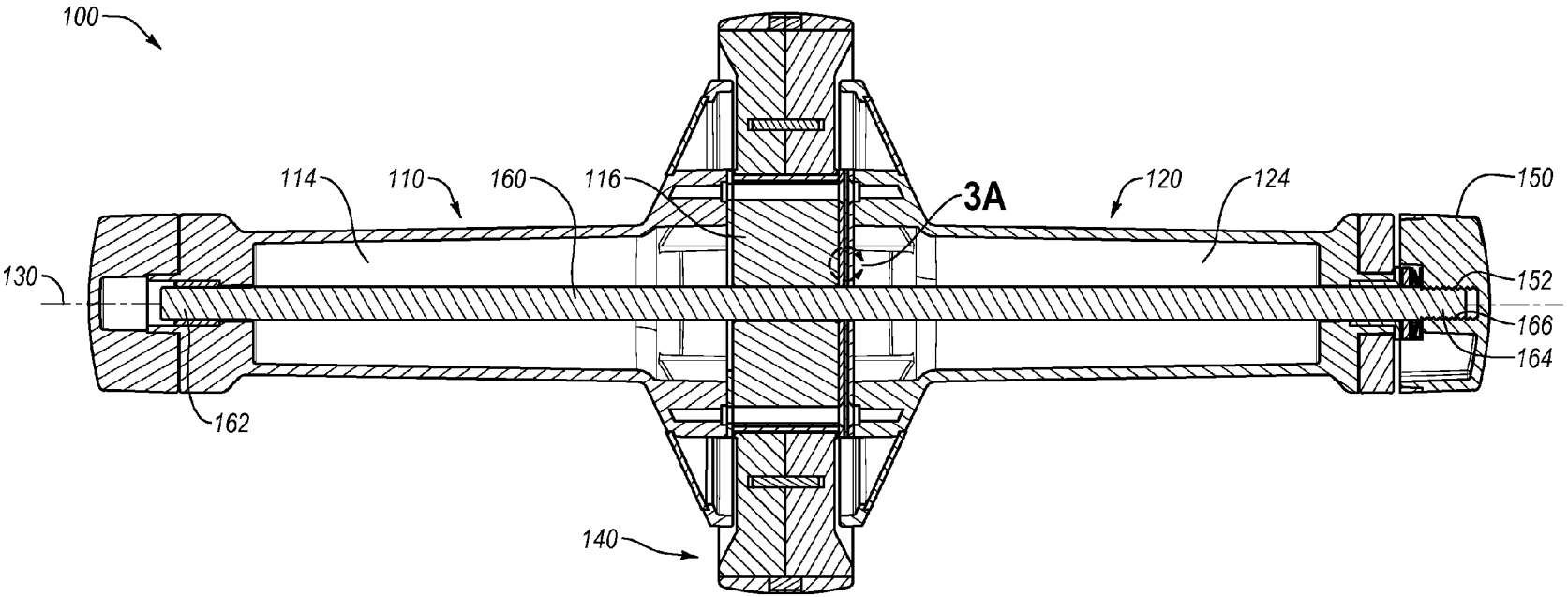
FIG. 3 illustrates a cross-sectional view of the hand-held exercise device of FIG. 1.
Figure 3A:
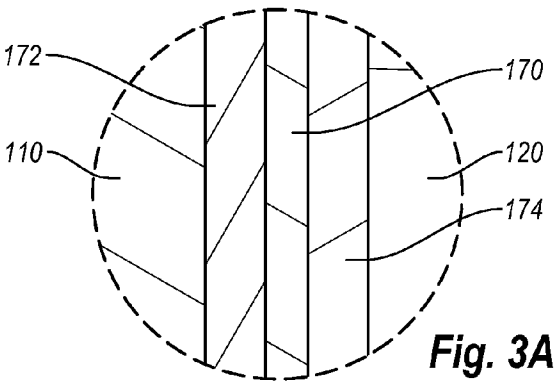
FIG. 3A illustrates a detail view of a portion of the hand-held exercise device of FIG. 1.

FIG. 3 illustrates a cross-sectional view of hand-held exercise device 100. As can be seen in FIG. 3, first handle 110 defines a first interior space 114. Second handle 120 defines a second interior space 124. Adjustment rod 160, which has a first end 162 and second end 164, is partially housed within first and second interior spaces 114 and 124. Indeed, adjustment rod 160 passes through second handle 120 within the second interior space 124 such that a portion of the second end 164 of adjustment rod 160 extends outside second interior space 124 and beyond the free end of second handle 120. First end 162 of adjustment rod 160 is rigidly secured to first handle 110. Second end 164 of adjustment rod 160 includes an externally threaded portion 166. Adjustment knob 150 includes an internally threaded portion 152 that mates with externally threaded portion 166 of adjustment rod 160.

First handle 110 and second handle 120 are positioned adjacent to one another and can be in direct or indirect contact. Regardless of whether first handle 110 and second handle 120 are in direct or indirect contact, a frictional force exists between the two handles that resists rotation of first handle 110 and second handle 120 in opposite directions. The strength of this frictional resistance can be based on several different factors, including the amount of pressure that exists between the first handle 110 and second handle 120 and the materials that are in direct rotational contact with one another. Materials with a higher frictional coefficient will provide more rotational resistance than materials with a lower frictional coefficient.

In exercise device 100, first handle 110 is in indirect contact with second handle 120. FIG. 3A shows more clearly this indirect connection. As can be seen in FIG. 3A, three different friction discs 170, 172, and 174 are positioned between first handle 110 and second handle 120. Friction disc 172 is secured to first handle 110. Friction disc 174 is secured to second handle 120. Friction disc 170 is positioned between discs 172 and 174 and is able to rotate freely therebetween. Friction discs 170, 172, and 174 can be made from any material that is suitable to withstand the pressures and forces that may exist between first and second handles during performance of exercises using exercise device 100. For example, one or more of the friction discs can be made of leather, rubber, plastic, ceramics or metal. Combinations of these materials may also be used. For example, friction discs 172 and 174 can be made of plastic and friction disc 170 can be made of leather.

The amount of pressure exerted upon friction discs 170, 172, and 174 (or in other words, how tightly the first handle and second handles 110 and 120 are held together) can be fixed or variable. The ability to adjust the pressure that exists between handles 110 and 120 can be beneficial, as this pressure determines, at least in part, the rotational resistance between the handles. As the pressure increases, the frictional resistance also increases, making it more difficult to rotate the handles in opposite directions. In exercise device 100, the pressure between first handle 110 and second handle 120 is variable and can be adjusted by a user.

As can be seen in FIG. 3, exercise device 100 includes an adjustment knob 150 that is secured to the second end 164 of adjustment rod 160 through the mating threaded portions 166 and 152. The threaded portions allow a user to secure the adjustment knob 150 to the adjustment rod 160 by rotating the adjustment knob 150 relative to the adjustment rod 160. As adjustment knob 150 rotates in one direction about the second end 164 of adjustment rod 160, it will move closer to the first end 162 thereby bringing the first handle 110 and second handle 120 closer together. The pressure between first handle 110 and second handle 120 increases as the space between the first handle 110 and adjustment knob 150 decreases. Thus, a user can rotate the adjustment knob 150 in one direction (for example, counter-clockwise) about adjustment rod 160 to decrease the frictional resistance between the first handle 110 and second handle 120. A user can also rotate the adjustment knob 150 in another direction (for example, clockwise) about adjustment rod 160 to increase the frictional resistance between the first handle 110 and second handle 120.

In exercise device 100, wheel 140 can rotate independent of the relative rotation of and frictional resistance between first handle 110 and second handle 120. For example, as can be seen in FIG. 2, wheel 140 rotates about hub 116. On the lateral side of hub 116 is friction disc 172, which defines the area where the first and second handles are rotatably connected. Thus, for example, wheel 140 will rotate about first and second handles 110 and 120 regardless of any pressure that exists between the handles.

Figure 4:
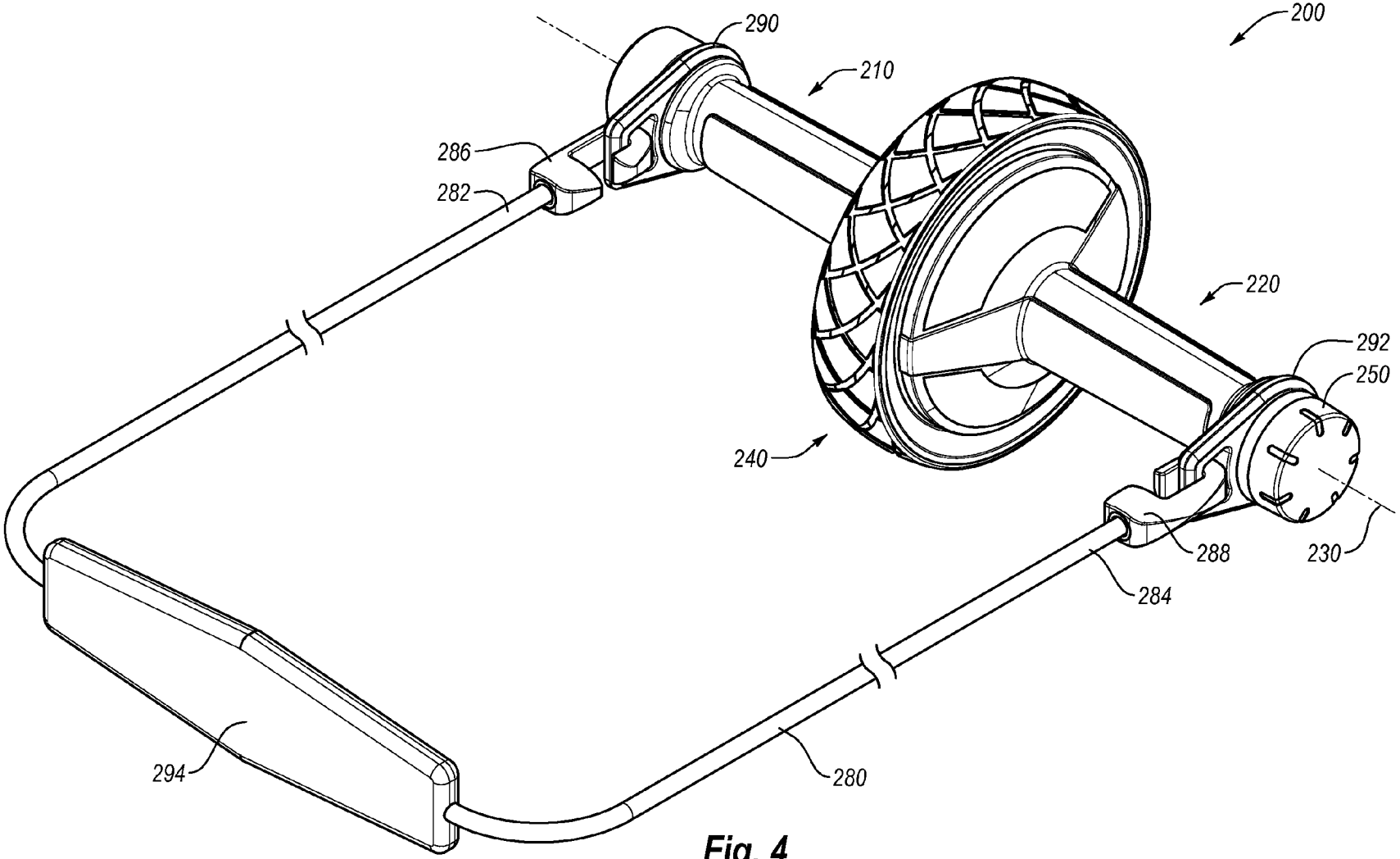
FIG. 4 illustrates a perspective view of another embodiment of a hand-held exercise device according to the present invention.

FIG. 4 illustrates a perspective view of another embodiment of a hand-held exercise device 200 that is similar or identical to exercise device 100 in many respects. For instance, exercise device 200 includes a first handle 210, a second handle 220, and a wheel 240. First handle 210 and second handle 220 rotate in opposite rotational directions about an axis 230. Device 200 may also include one or more friction discs similar or identical to those described above. Wheel 240 rotates about axis 230 independently of the relative rotation between first handle 210 and second handle 220.

Exercise device 200 also includes a stretchable band 280 that is secured to exercise device 200. Stretchable band 280 includes a first end 282, which is attached to first handle 210. More specifically, first end 282 of band 280 is secured to a first hook 286, which can be detachably secured to a first anchor 290. First anchor 290 is secured to first handle 210. Stretchable band 280 also includes a second end 284, which is attached to second handle 220. More specifically, second end 284 of band 280 is secured to a second hook 288, which can be detachably secured to a second anchor 292. Second anchor 292 is secured to second handle 220.

Stretchable band 280 may also include a pad 294. Pad 294 may be a cushioned material that can be positioned behind a user's legs, feet, or another part of a user's body while the user performs an exercise with exercise device 200. While a pad 294 may make the exercise more comfortable, it is not necessary. Stretchable band 280 may lack a pad such that the stretchable band alone is positioned behind a user's legs, feet, or another part of a user's body during performance of an exercise.

Figure 5:
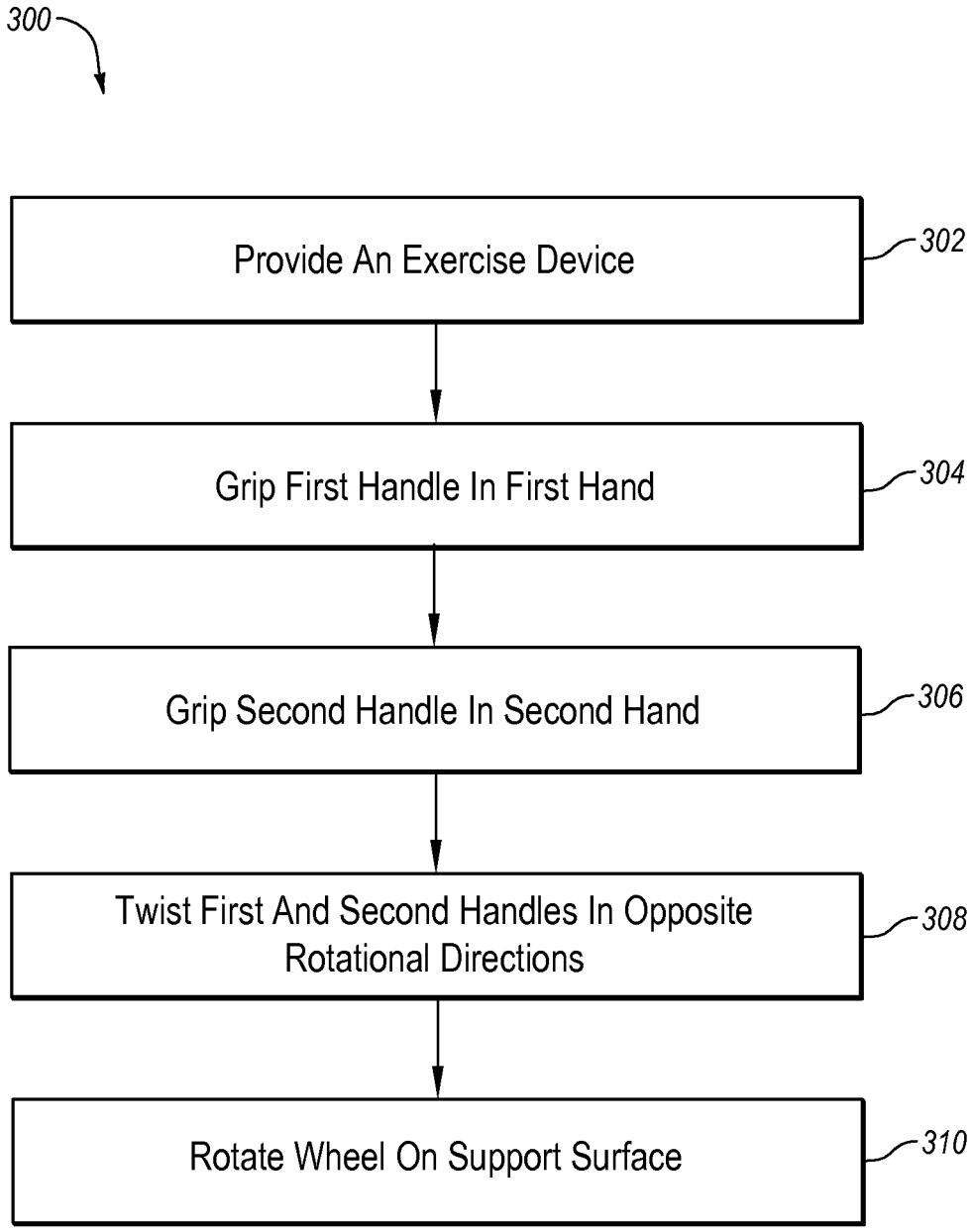
FIG. 5 illustrates steps that may be implemented in a method for performing arm and core muscle exercises using a single exercise device.

The present invention also includes a method 300 for performing arm and core muscle exercises using a single exercise device. FIG. 5 illustrates steps that may be implemented in method 300 for performing arm and core muscle exercises using a single exercise device. In a first step 302, an exercise device having a first handle, a second handle, and a wheel, is provided. The first handle is rotatably connected to the second handle and the wheel is rotatably disposed about at least one handle. The wheel is rotatable independently of the relative rotation of the first and second handles. In second step 304, a user grips the first handle in a first hand. In a third step 306, the user grips the second handle in a second hand. In a forth step 308, the user twists the first and second handles in opposite rotational directions about a central axis to exercise arm muscles. In a fifth step 310, the user rotates the wheel on a support surface. For example, when rolling the wheel on a support surface, the user's body may move between a prone position and a kneeling position to exercise core muscles.

INDUSTRIAL APPLICABILITY

In general, the exercise devices disclosed herein can be used to perform different type of exercises, which focus on different muscular groups of the body. Specifically, each of the various embodiments of exercise devices disclosed herein can be used to perform arm exercises as well as abdominal and core muscle exercises.

To exercise arm muscles, a user can grasp the handles of the exercise device in his or her hands and twist the handles in different directions. A rotational resistance can be applied to the handles to oppose the twisting movement of the handles. This rotational resistance can be fixed or it can be variable. A knob can be conveniently placed on any part of the exercise device to interact with an adjustment rod to selectively adjust the amount of resistance applied to the handles. The knob may, but need not, rotate about the same axis as the handles.

Further, a knob may selectively apply a resistance to rotation of the handles, rotation of the wheel, or both. For example, a wheel, or a portion thereof, could include a surface upon which pressure is applied as a first handle and second handle are moved closer together. In such an embodiment, an adjustment knob would not only control the amount of rotational resistance applied to the first and second handles, but it would also control the amount of rotational resistance applied to the wheel. In alternative embodiments, an exercise device may include two different knobs, where the first knob applies an adjustable resistance to relative rotation of the handles and the second knob applies an adjustable resistance to the rotation of the wheel.

Handles, according to the present invention, need not be straight, but can be curved or have another ergonomic shape. In alternative embodiments, handles could have multiple grip portions such that a user can exercise or target different muscles or muscle groups depending on the placement of the hands. Further, a hub about which a wheel rotates may be part of a first handle, a second handle, or the hub may be divided into two parts, with one part being formed as part of the first handle and the other part being formed as part of the second handle. In addition, the hub may not be part of either the first or second handles, but may be a separate component that is positioned between the first handle and the second handle.

In addition, a wheel need not rotate on a plane that lies between grip portions of handles. In another embodiment, a wheel may rotate on a plane that is not between grip portions of handles. For example, an embodiment of the present invention may include two wheels that rotate on two separate parallel planes. The grip portions of handles in this embodiment may be between the two planes on which the wheels rotate.

Adjustment rods, according to the present invention, need not extend through a first handle. Indeed, an adjustment rod need not extend at all into the first handle, but can be rigidly secured to an outer surface of the first handle. In such an embodiment, the first handle need not define an inner space, but can be solid. Further, an adjustment rod need not extend through a second handle or may only extend through a portion of the second handle. In such an embodiment, the second handle need not define an inner space and can also be solid.

To exercise abdominal or core muscles, a user can grasp the handles of the exercise device in his or her hands and roll the wheel on a support surface, such as a floor. The user can maintain a portion of his or her body, for example the knees, in direct contact with the support surface such that as the user rotates the wheel, the user can move his or her body from a prone position with arms extended to a kneeling position. A user could also use the exercise device of the present invention to move his or her body from a prone position to a bending position with the user's feet, but not knees, in direct contact with the support surface. A stretchable band can be attached to the exercise device to assist the user in moving from a prone position to a kneeling or bending position. The band can be secured to the exercise device and loop around the user's body. For example, the band can be positioned behind a user's feet or legs.

Anchors and hooks can be used to selectively attach and remove the stretchable band, but are not necessary. In other embodiments, the stretchable band can be secured directly to the first and second handles or other portions of an exercise device.

The exercise devices disclosed herein can include a single wheel or multiple wheels. For example, in one embodiment an exercise device could have two wheels that are positioned on outer sides of each handle. Further, the stretchable band need not form a closed loop. In alternative embodiments, an exercise device may include two elastic band members that attach to a support structure such as a wall or a door.

The invention claimed is:

1. An exercise device comprising:

a first handle having a first outer grip portion;

a second handle having a second outer grip portion, wherein the first and second handles are rotatable relative to one another in opposite directions about a central axis;

a wheel rotatably disposed about at least one of the first and second handles, the wheel being rotatable about the central axis independently of the relative rotation between the first and second handles; and a first friction disc, the first friction disc being positioned between the first handle and the second handle and being in contact with at least one of the first handle or the second handle wherein the first friction disc is positioned to interface with a second friction disc.

2. The exercise device of claim 1, wherein the first handle and second handle are in direct contact with one another.

3. The exercise device of claim 1, wherein the friction disc is made at least in part from leather.

4. The exercise device of claim 1, wherein the plane on which the wheel rotates lies between the outer grip portion of the first handle and the outer grip portion of the second handle.

5. The exercise device of claim 1, further comprising a stretchable band having a first end and a second end, the first end being secured to the first handle and the second end being secured to the second handle.

6. The exercise device of claim 5, further comprising a first hook secured to the first end of the stretchable band and a second hook secured to the second end of the stretchable band, wherein the first and second hooks can be selectively secured to the first and second handles.

7. The exercise device of claim 5, wherein the stretchable band further comprises a pad that can be positioned behind a user's feet or legs during performance of an exercise.

8. The exercise device of claim 1, further comprising:

an adjustment rod secured to the first handle, the adjustment rod having an externally threaded portion at one end; and an adjustment knob rotatably secured to the adjustment rod, the adjustment knob having an internally threaded portion that mates with the externally threaded portion on the adjustment rod, wherein at least a portion of the second handle is positioned between the adjustment knob and the first handle such that as the adjustment knob is tightened on the adjustment rod, the first and second handles are brought closer together.

9. The exercise device of claim 8, wherein the adjustment rod extends through the entire length of the second handle.

10. The exercise device of claim 8, wherein a rotational resistance on the wheel is selectively adjustable by rotating the adjustment knob.

11. The exercise device of claim 1, wherein the outer grip portions of the first and second handles are covered in part or in whole by a slip resistant material.

12. The exercise device of claim 1, wherein the wheel includes an outer tread that provides traction between the wheel and a support surface on which the wheel rotates.

13. An exercise device comprising:

an adjustment rod having an externally threaded portion at one end;

a first handle secured to the adjustment rod, the first handle having a first outer grip portion;

a second handle rotatably disposed about at least a portion of the adjustment rod, the second handle having a second outer grip portion, wherein the first and second handles are rotatable relative to one another in opposite rotational directions about a central axis;

an adjustment knob rotatably secured to the adjustment rod, the adjustment knob having an internally threaded portion that mates with the externally threaded portion on the adjustment rod, wherein at least a portion of the second handle is positioned between the adjustment knob and the first handle such that as the adjustment knob is tightened on the adjustment rod, the first and second handles are brought closer together; and a wheel rotatably disposed about at least one of the first and second handles, the wheel being rotatable about the central axis independently of the relative rotation of the first and second handles; and a first friction disc, the first friction disc being positioned between the first handle and the second handle and being in contact with at least one of the first handle or the second handle wherein the first friction disc is positioned to interface with a second friction disc.

14. The exercise device of claim 13, wherein the adjustment knob is rotatable about the central axis to selectively increase or decrease the rotational resistance between the first and second handles.

15. The exercise device of claim 13, wherein a rotational resistance on the wheel is selectively adjustable by rotation of the adjustment knob.

16. The exercise device of claim 13, further comprising a stretchable band having a first end and a second end, the first end being secured to the first handle and the second end being secured to the second handle.

17. A method for performing arm and core muscle exercises using a single exercise device, the method comprising:

providing an exercise device having a first handle, a second handle, and a wheel, wherein the first handle is rotatably connected to the second handle and the wheel is rotatably disposed about at least one of the first and second handles, the wheel being rotatable independently of the relative rotation of the first and second handles, the exercise device also having at a first friction disc, the first friction disc being positioned between the first handle and the second handle and being in contact with at least one of the first handle or the second handle wherein the first friction disc is position to interface with a second friction disc;

gripping the first handle in a first hand;

gripping the second handle in a second hand;

twisting the first and second handles relative to one another in opposite rotational directions about a central axis; and rotating the wheel on a support surface to move a user's body between a prone position to a kneeling position.

* * * * *